US007241227B2

(12) United States Patent
Campbell

(10) Patent No.: US 7,241,227 B2
(45) Date of Patent: Jul. 10, 2007

(54) SHORT-HOLE, SAND-TRAP, GOLF GAME

(75) Inventor: Owen Campbell, 915 Bevridge Rd., Richmond, VA (US) 23226-3038

(73) Assignee: Owen Campbell, Richmond, VA (US)

( * ) Notice: Subject to any disclaimer, the term of this patent is extended or adjusted under 35 U.S.C. 154(b) by 0 days.

(21) Appl. No.: 11/133,439

(22) Filed: May 20, 2005

(65) Prior Publication Data

US 2006/0046862 A1 Mar. 2, 2006

Related U.S. Application Data

(60) Provisional application No. 60/603,722, filed on Aug. 24, 2004.

(51) Int. Cl.
*A63B 67/02* (2006.01)

(52) U.S. Cl. ..... 473/170; 473/172; 473/173

(58) Field of Classification Search ..... 473/167–173; 404/76

See application file for complete search history.

(56) References Cited

U.S. PATENT DOCUMENTS 3,578,333 A * 5/1971 Elesh ..... 473/171
3,990,708 A * 11/1976 Ingwersen ..... 473/153
5,060,956 A * 10/1991 Glass ..... 273/409
5,092,600 A * 3/1992 Ruth et al. ..... 473/168
5,112,054 A * 5/1992 Oswald ..... 473/156
5,401,027 A * 3/1995 Surbeck ..... 473/173
5,580,320 A * 12/1996 Meikle ..... 473/197
5,993,322 A * 11/1999 Consalvi ..... 473/168
6,367,797 B1 * 4/2002 McKenna-Cress et al. ..... 273/108.2
2004/0156679 A1 * 8/2004 Jenkins et al. ..... 404/76

FOREIGN PATENT DOCUMENTS

JP 06142272 A * 5/1994

* cited by examiner

*Primary Examiner*—Mark S Graham
(74) *Attorney, Agent, or Firm*—Millen, White, Zelano & Branigan, P.C.

(57) ABSTRACT

A golf-like, short-hole, pitch-and-chip target game has an elongated course of predetermined length and width and at least one lie location at one end of the course and at least one sand trap that is divided into at least first and second divisions, the first division having a first scoring value and the second division having a second scoring value wherein the sand trap is located a predetermined distance from the lie so that a chip shot or a pitch shot of a ball from said lie can land in one of the divisions of the sand trap which has a sand composition such that a ball falls essentially dead upon striking the sand.

2 Claims, 3 Drawing Sheets

| TRAP # | YARDS | | | | |
|---|---|---|---|---|---|
| 1 | 15 | | | | |
| 2 | 20 | | | | |
| 3 | 35 | | | | |
| 4 | 30 | | | | |
| 5 | 25 | | | | |
| 6 | 45 | | | | |
| 7 | 40 | | | | |
| 8 | 35 | | | | |
| 9 | 35 | | | | |
| TOTAL | | | | | |

THE PITCH AND CHIP
IT'S ALL GOLF

| TRAP # | YARDS | | | | |
|---|---|---|---|---|---|
| 10 | 20 | | | | |
| 11 | 45 | | | | |
| 12 | 40 | | | | |
| 13 | 25 | | | | |
| 14 | 25 | | | | |
| 15 | 30 | | | | |
| 16 | 25 | | | | |
| 17 | 40 | | | | |
| 18 | 40 | | | | |
| TOTAL | | | | | |

SHORT-HOLE, SAND-TRAP, GOLF GAME

This application claims the benefit of the filing date of U.S. Provisional Application Ser. No. 60/603,722 filed Aug. 24, 2004 which is incorporated by reference herein.

BACKGROUND

This invention relates to golf and more particularly to a short-hole, pitch-and-chip golf game.

PRIOR ART

Several issued patents relate to custom-designed layouts for golf-like games to reduce the amount of land required for a course. There are also many one-shot-per-target games using target-based scoring; and, hook-and-pile balls and targets are marketed under the "Velcro" trademark in toy stores.

The patent literature also discloses short-course systems with sand traps; and, other patents disclosed target greens having generally concentric scoring portions and traps.

SUMMARY

A short golf "hole" in accordance with the invention includes a suitable lie and a sand trap located about 15 to 45 yards from the lie. The trap is divided into a plurality of divisions such as an inner, a middle and an outer division and the trap's sand or the like is textured so that a conventional golf ball that is lofted from the lie falls dead upon impacting the sand. Such a short course hole construction of the invention is suitable for location in an individual golfer's yard; and, a larger number of such holes, such as 9 or 18, can be located along with a clubhouse or the like in a relatively small tract such as two to six acres.

According to a method of the invention, a golfer uses only a single stroke per "hole"—the golfer's score depending upon whether the lofted ball lands in the trap; and if so, upon the division of the trap into which the ball falls dead.

The course and method of the invention have many advantages. Play, for example, is based on skill rather than luck as is often the case in putt-putt courses. The compactness of the invention permits a "hole" to be located on a residential building lot and/or as a pitch-and-chip facility at a commercial golf course. Further, the invention is suitable for both professionals and amateurs; the required playing time is measured in minutes rather than hours; and, an entire 18 hole course requires the space of only about a conventional par-five hole. Therefore, it is also suitable for urban and suburban park sites. Additionally, only one or two clubs are required: no golf carts are required: and, very little walking is required so that the invention is suited for young, old or handicapped. Further, the small size of a single hole or an entire course permits inexpensive, practical lighting and convenient night-time play.

As contrasted with, conventional golf games where the golfer endeavors to avoid sand traps, the instant invention requires the golfer purposely to land the ball in a trap.

DESCRIPTION OF THE DRAWINGS

The foregoing and other objects, features and advantages of the invention will be apparent from the following more specific description of a preferred embodiment of the invention as illustrated in the accompanying drawings. The drawings are not necessarily intended to be to scale, emphasis instead being placed upon illustrating principles of the invention in a clear manner.

DESCRIPTION OF PREFERRED EMBODIMENTS

Figure 1:
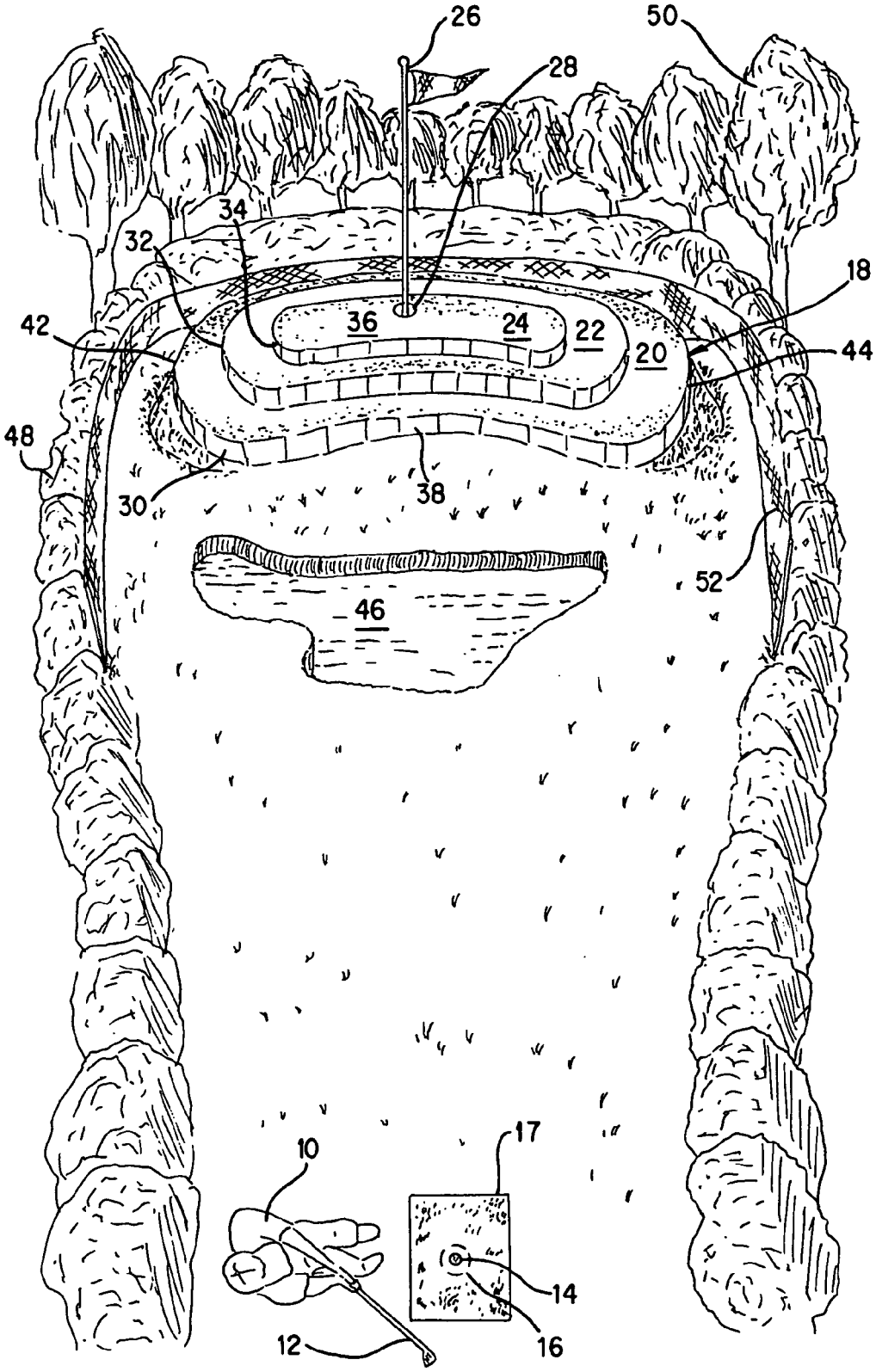
FIG. 1 is a schematic illustration of a single "hole" structured in accordance with the invention.

FIG. 1 illustrates a single "hole" wherein a golfer 10 uses a suitable club 12 to chip or pitch a ball 14 located at a lie 16 on a mat or the like 17 toward a sand trap 18 comprised of concentric-like divisions 20, 22 and 24.

FIG. 1 also includes a pin and flag 26. Preferably there is no cup, but in some cases it may be desired to include a cup 28. The concentric-like divisions 20, 22 and 24 are defined by raised portions 30, 32 and 34 preferably comprised of flexible material such as garden edging, preferably of the type having a hollow-bead top. A preferred edging is made of strong, flexible polyethylene and the hollow-bead top is integral with a substantially vertical bottom portion which is placed three or so inches into the trap's sand. If desired, the lower portion can include one or more horizontal ribs to resist being pulled out of sand. One such edging is sold by Suncast Corp. of Batavia, Ill. and identified as "IND 20/40 industrial grade edging". Other edgings can also be used as divisions, but should be of a type that keeps a ball from significantly bouncing should it happen to strike a raised divider portion 30, 32, or 34.

The trap material 36 is preferably conventional sand. The United State Golf Association specifies sand-trap sands by names such as "near white" and "Mattaponi Lite". Either of these sands is suitable, but other materials such as saw dust can be used so long as the chipped or pitched ball falls dead upon landing in the trap.

Figure 2:
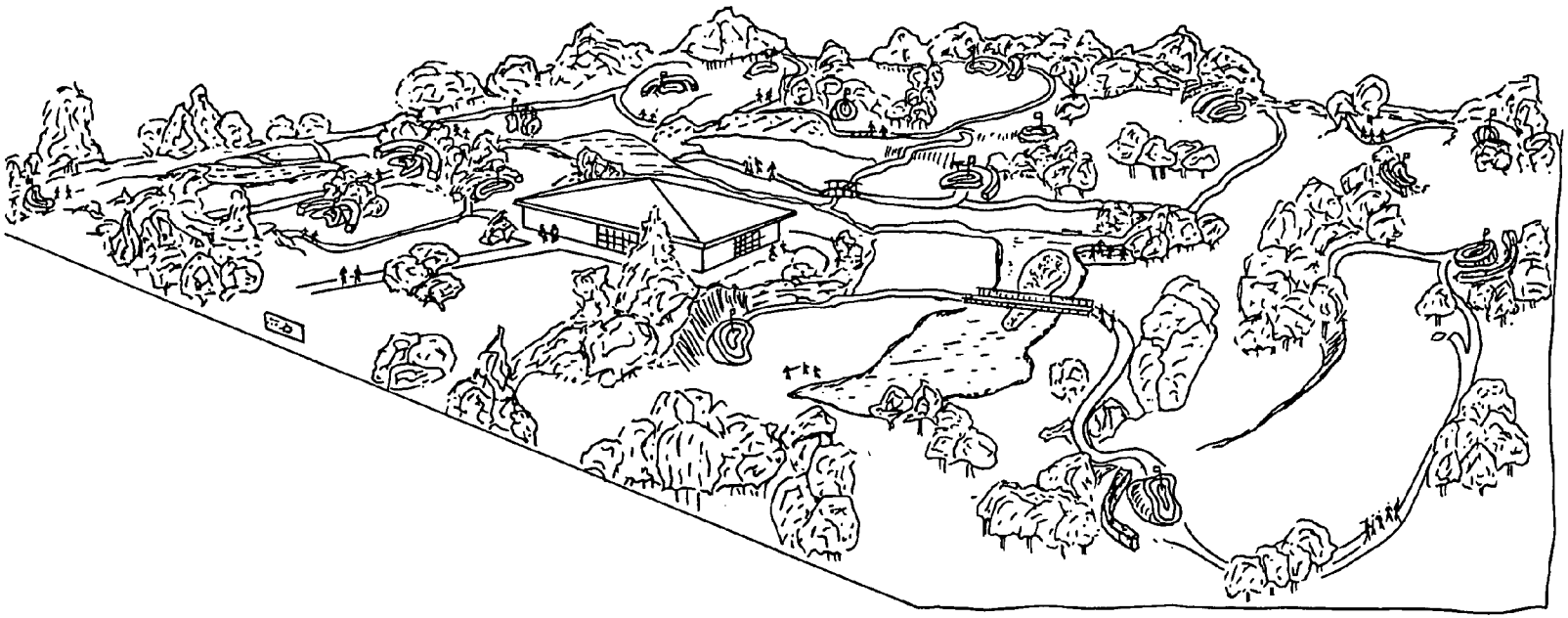
FIG. 2 is a schematic illustration of an entire course comprised of a plurality of "holes" according to the invention; and, FIG. 3 illustrates a score card of a type which might be used in practicing the method of the invention.

As shown in FIG. 2, an entire pitch-and-chip course can be constructed from a plurality of short-holes as described above, with each hole having its own location and configuration as determined by the characteristics of the area such as trees, water, hills, banks, valleys, and the like. In this manner, the course is designed so that the target areas fit in with the natural surroundings and add beauty, prestige, and dignity to urban or suburban recreational parks. The courses also compliment recreational areas, full-size golf courses or tourist areas. Another advantage of the invention is its ability to be designed so that an entire short-hole course is suited to a small parcel of land such as only 2 to 6 acres or so.

Figure 3:
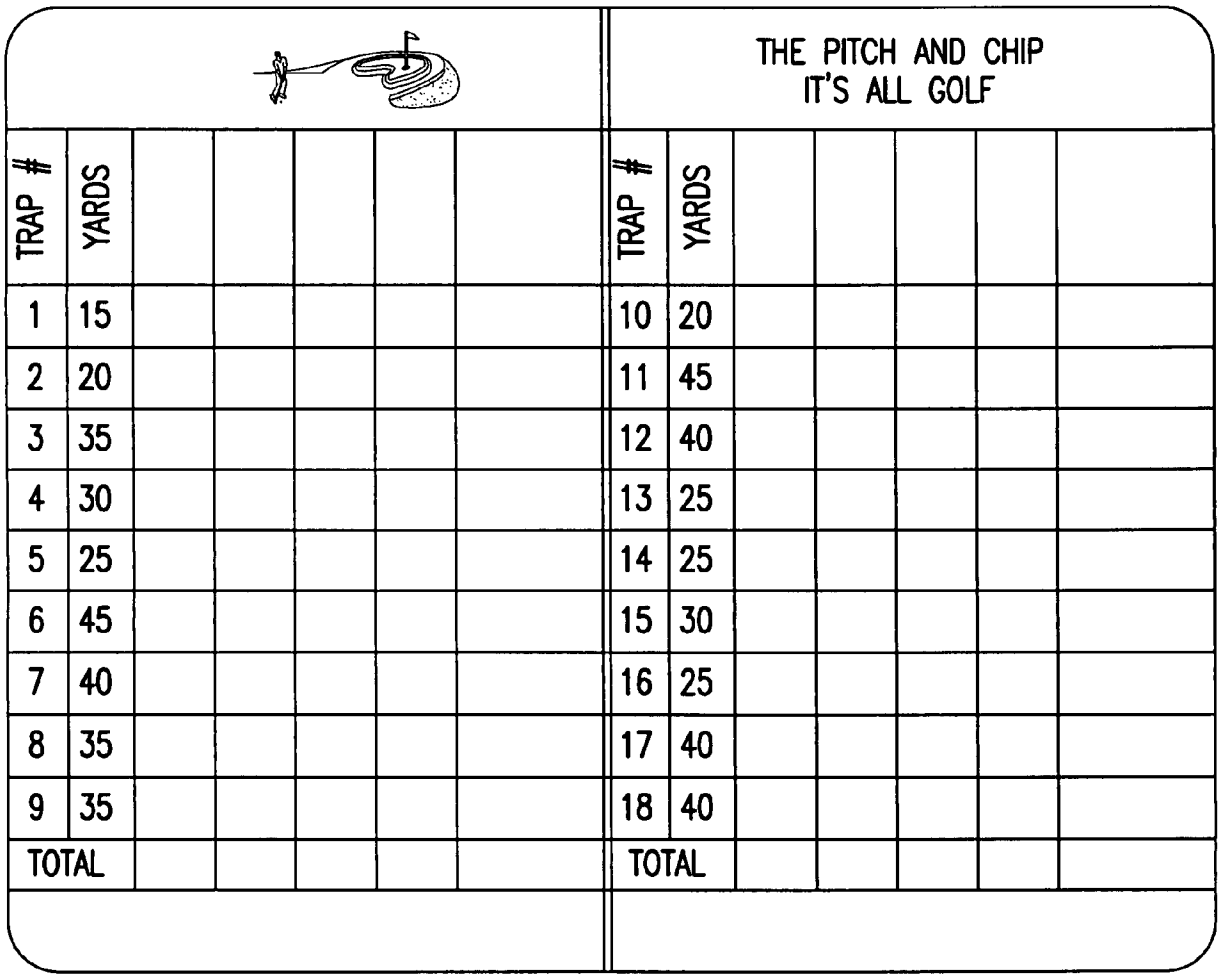

Each of the traps can have its own diameter, shape and distance to the "Tee" or lie 16. As shown in FIG. 3 which illustrates a typical score card, the distance from a lie or "tee" area can vary from as little as 15 yards or less, to as many as 45 yards or more depending upon the topography of the land and/or the imagination of the landscape architect. The shorter holes provide practice for improving chip-shot skills wherein the golfer can be expected to hit down on the ball to give it a backward spin and a shorter ball projectory. Longer holes, on the other hand, test the skills of the golfer's pitching abilities wherein the ball's projectory is normally higher with less spin and a bit longer trajectory. In either case, however, the invention contemplates the ball stopping dead in the trap without significant rolling at the end location so that the score of the stroke can be easily determined.

As noted, the shape and size of each hole and distance from the lie can differ. Longer holes, for example, can have larger trap areas and larger division areas. For a 15-yard hole the distance from the front edge 38 of the trap 18 to the back 40 of the trap might be only 10 ft.—with the front-to-back distances of each of the divisions 20, 22 and 24 being only about 2 ft. Similarly, the width of a 15-yard hole from the left edge 42 in FIG. 1 to the right edge 44 might be on the order of 20 ft. with the widths of the inner, middle and outer divisions 24, 22 and 20 proportionately wider than their depths. A 45 yard hole, on the other hand would preferably be proportionally larger so that, for example, it might be 20 feet deep and 40 feet wide.

As illustrated in FIGS. 1 and 2, it is preferred that the various traps be inclined from back to front and/or side to side, so that, particularly on the longer holes, the golfer can easily discern the various divisions within the trap when the golfer is standing at the tee area. In FIG. 1, for example, the rise from front portion 38 to back portion 40 would be such that the resulting incline is between about 5 and 30° but in any event not so steep as to prevent the ball from stopping dead upon impacting the trap's sand.

In accordance with a preferred embodiment, a ball landing in an inner division such as 24 in FIG. 1 receives a score of 1. A ball landing in a middle division such as 22 would score 2 and a ball landing in an outer division such as 20 would score 3. A ball not landing anywhere in the trap 18, however, would score 5. In this manner, a golfer's score for the entire 18-hole course illustrated in FIG. 2 would be between 18 and 90. If a cup 28, is employed, for example, the golfer might receive a bonus for hitting a hole-in-1. Similarly, if the golfer's ball hits a hazard such as water hole 46 in FIG. 1 or lands in landscaping such as 48 or 50, the golfer could be assessed a penalty. In a preferred embodiment, a barrier such as "chicken wire" or the like is inserted in front of the landscaping 48 so that errant golf balls don't roll into the trees or shrubbery and the golfers don't have to look for balls.

The lie 16 in FIG. 1 is preferably on mat 17 which can be fabricated from artificial turf or the like.

A professional golfer could be expected use a sand wedge for an entire course and would probably hit the trap on every hole. An amateur golfer, however, depending upon the golfer's skills, might prefer to use between a 7 and a 9 iron and might be pleased if the trap is hit in 9 or 10 holes.

A chip shot is one of the most delicate and difficult shots in golf, but also one of the most useful. Indeed, it is believed by some, that the best way significantly to lower one's average score is to master the chip shot which is believed by some to be more important to a golfer's score than the golfer's driving and putting.

A regular golf course can typically occupy 200 acres; take several hours to play; and the cost of play can vary from relatively modest sums to several hundreds of dollars at the more prestigious courses. The instant game on the other hand, is well suited for a single "hole" on a residential lot; and, an 18 hole course can be located on as few as two to six acres. Such a course of the invention can be played in twenty to thirty minutes and there is no requirement for cups nor greens, nor lengthy fairways, nor golf carts, nor a large variety of clubs, nor even a golf bag. Moreover, because of the small, size of such a course, not only is its initial expense relatively small but the playing time is a fraction of a regular game so that a course operator can rapidly run a plurality of players through the course in a short time. Therefore, the operator can afford to charge a far smaller fee than is required for a regular course. A golfer's score on the other hand, is based essentially on the golfer's skill rather than the luck which is usually involved in a miniature-golf-putting course.

The game of the invention is also well suited for foursomes or the like. That is, because a given hole only employs a single stroke, all golfers in a foursome make their shots in seriatim from tee area 16 without a prior golfer's ball interfering with a subsequent golfer's shot.

In a preferred embodiment of the invention, a conventional ball retriever can be used to retrieve balls from the trap so that a given trap's sand is not overly compacted by the weight of a golfer. When the game is played by a foursome or the like, the ball retriever can be adapted to retrieve a plurality of balls rather than just one.

Although the invention has been specifically shown and described with reference to preferred embodiments, it will be understood by those skilled in the art that various changes in form and detail maybe made therein without departing from the spirit and scope of the invention.

From the foregoing description, one skilled in the art can easily ascertain the essential characteristics of this invention and, without departing from the spirit and scope thereof, can make various changes and modifications of the invention to adapt it to various usages and conditions.

The embodiments of the invention in which an exclusive property or privilege are claimed are defined as follows:

What is claimed is:

1. A playing field for a golf-like, short-hole, pitch-and-chip target game, said field comprising:

an elongated course of predetermined length and width;

at least one sand trap having a predetermined size and having a central portion;

at least one lie location at one end of said course from which a golf ball is to be aimed so as to land in said central portion of said trap located a predetermined distance from said lie;

at least one divider means for dividing said sand trip into at least a first division having a first scoring value and a second division having a second scoring value and wherein said first division is in said central portion and said second division surrounds said first division;

said sand trap being located a predetermined distance from said lie so that a chip or pitch of said ball from said lie can land in said sand trap;

the composition of said sand in sand trap being such that a ball that is struck by said club from said lie falls essentially dead upon striking said sand said divider being of a flexible, edging material comprised of a flexible polyethylene having a hollow-bead top portion and a substantially vertical bottom portion depending from said hollow-bead top, said bottom portion being adapted to extend into the sand of said trap.

2. The playing field of claim 1 wherein said substantially vertical bottom portion includes at least one horizontal rib to resist said flexible edging from being pulled out of said sand.

* * * * *